United States Patent [19]

Beck

[11] Patent Number: 4,621,622

[45] Date of Patent: Nov. 11, 1986

[54] APPARATUS FOR ENTERTAINMENT, THERAPEUTIC USES AND THE LIKE

[76] Inventor: Norman Beck, 541 Mellon St., Pittsburgh, Pa. 15206

[21] Appl. No.: 722,600

[22] Filed: Apr. 12, 1985

[51] Int. Cl.[4] ..... A61H 11/00

[52] U.S. Cl. ..... 128/58; 128/57; 446/487

[58] Field of Search ..... 272/67, 68, 93; 446/487, 102, 104; 128/57, 58

[56] References Cited

U.S. PATENT DOCUMENTS 1,516,344 11/1924 Knowles ..... 128/58

FOREIGN PATENT DOCUMENTS 535765 3/1955 Belgium ..... 446/487

*Primary Examiner*—Richard J. Apley
*Assistant Examiner*—John L. Welsh
*Attorney, Agent, or Firm*—Arnold B. Silverman

[57] ABSTRACT

An apparatus for entertainment, therapeutic or other purposes is provided. It has a plurality of frame elements and cooperating pivotable elements which define a closed loop having universal joint features. A pair of exterior framing elements may have a pair of axles through which a pair of pivotal elements are secured in such a manner that the pivotable elements will rotate about a first axle on a first framing element and about a second axle on a second framing element. The pivotable elements may assume a geometric shape such as being spherical. The closed loop preferably has at least six framing elements.

16 Claims, 7 Drawing Figures

APPARATUS FOR ENTERTAINMENT, THERAPEUTIC USES AND THE LIKE

BACKGROUND OF THE INVENTION

1. Field of the Invention

The present invention relates to apparatus for entertainment, therapeutic or other purposes and, more specifically, it relates to closed loop apparatus which has unique universal rotation elements.

2. Description of the Prior Art

Various forms of manually operable and manually supportable devices having a wide variety of motions have long been known for recreational and therapeutic purposes.

SUMMARY OF THE INVENTION

The present invention has provided a unique construction of an assembly of frame elements and pivotable elements in such a manner that a closed loop is provided with a plurality of universal joints in a unique manner. Each framing member preferably has two pivotable elements rotatably secured thereto and each of the pivotable elements is preferably rotatable about a first axis provided by a first framing element and a second axis which is preferably generally perpendicular with respect to the first axis and is provided on a second, adjacent framing element.

The frame element may consist of a pair of exterior framing members and a pair of axles about which the pivotable elements rotate. A transverse framing member may be fixedly secured to the exterior framing members.

It is an object of the present invention to provide a closed loop recreational or therapeutic device which is adapted to permit a wide variety of rotational movement between the modular components thereof.

It is a further object of the present invention to provide such a device which may be readily employed in recreational, therapeutic and other uses and having a sufficient number of different relative rotational movements as to maintain interest on the part of the user.

It is a further object to provide such a device which is economical to manufacture and easy to use.

It is a further object of the invention to provide such a device which may be made in sufficiently small size as to be manually supportable, manually operable and adapted for desk-top use and, in addition, may readily be carried on one's person.

These and other objects of the invention will be more fully understood from the following description of the invention on reference to the illustrations appended hereto.

DESCRIPTION OF THE PREFERRED EMBODIMENTS

Figure 1:
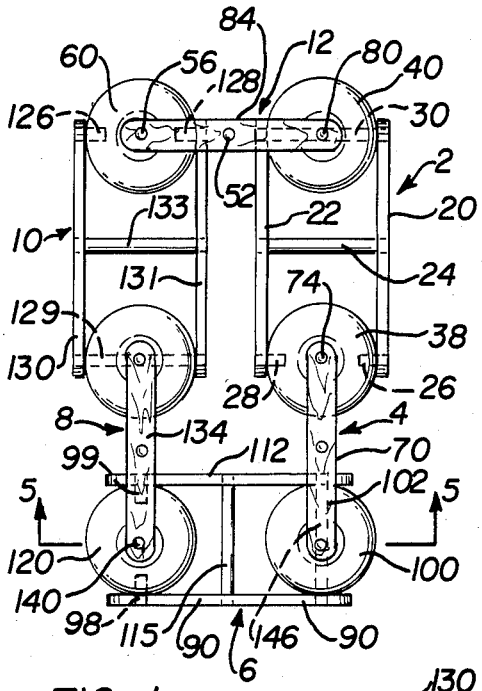
FIG. 1 is a front elevational view of one embodiment of a closed loop apparatus of the present invention.

Referring once again to FIG. 1, there is shown a form of the apparatus of the present invention wherein a plurality of frame elements 2, 4, 6, 8, 10, 12 are provided and secured so as to establish a closed loop. It will be noted that the frame element 2 has a pair of spaced, generally parallel exterior framing members 20, 22 which, in the form shown, are fixedly secured to transverse framing member 24. This generally H-shaped member provides the substantially rigid frame element 2. Adjacent one end of the frame element 2 is an axle 26, 28 which in the form shown is provided by a pair of axle elements which are fixedly secured to the exterior framing members 20, 22 and project inwardly to define an axle about which pivotable element 38 will rotate. Similarly, a continuous axle 30 which has opposed ends secured to exterior framing members 20, 22 is provided adjacent the other end and passes through a bore in pivotable element 40 to permit rotation thereabout. It would be appreciated that the pivotable elements 38, 40 would rotate about generally parallel axles 26, 28 and 30 which are oriented generally transversely within the frame element 2.

In the preferred form, each of the other frame elements 4, 6, 8, 10, 12 will be essentially identical to frame element 2 and have one solid axle and another segmented axle. It will be appreciated that the pivotable elements 38, 40 are of lesser height than the internal spacing between exterior framing members 20, 22 and, in the form shown, are of generally solid construction apart from the bores about which the spheres 38, 40 rotate.

In the form illustrated in FIG. 1, it will be appreciated that alternate adjacent framing members are oriented generally perpendicularly with respect to each other not only in the position shown in FIG. 1, but also in that each adjacent frame element has a position which is rotated 90 degrees with respect to the adjacent frame. This can best be appreciated by noting FIG. 4. It is also to be noted that with respect to a pair of adjacent frame elements, that they are capable of assuming positions wherein a plane passing through a frame member of a first frame element will be generally perpendicular to a plane passing through a frame member of an adjacent frame element.

Figure 2:
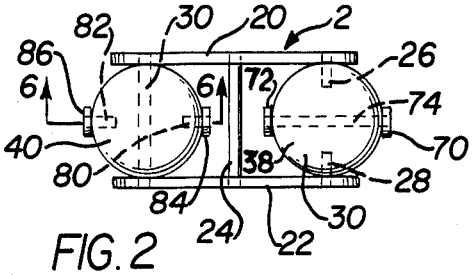
FIG. 2 is a top plan view of a modular element of a portion of the present invention.
Figure 3:
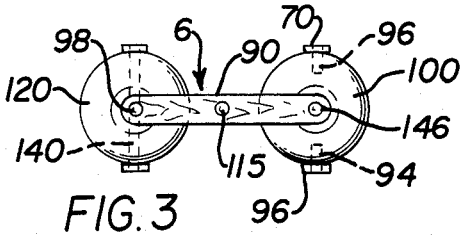
FIG. 3 is a front elevational view of a modular component of the present invention.

Referring to FIGS. 1 through 3, it is seen that the adjacent frame elements with respect to frame element 2 will also provide axles about which pivotable elements 38, 40 will rotate. These axles are preferably generally perpendicular with respect to the axles provided in frame element 2, i.e. continuous axle 30 and segmented axle 26, 28. As is shown in FIG. 2, a continuous axle 74 is provided between exterior frame member 70, 72 of frame element 4 and a discontinuous axle 80, 82 is provided between exterior frame members 84, 86 of frame element 12.

It will be appreciated that each pivotable element rotates about a first axle in a first frame element and also about a second axle in an adjacent framing element. This provides for the desired universal joint action.

As is shown in FIG. 1, frame element 12 has a transverse framing member 52, a continuous axle 56 passing through pivotable member or element 60 and a segmented axle 80 passing through pivotable member 40. Similarly, frame element 10 has a pair of exterior framing members 130, 131 and a transverse framing member 133. It also provides a segmented axle 126, 128 and a continuous axle 129.

Referring to FIGS. 1 and 3, the connections between frame element 6 and the adjacent frame elements 4 and 8 will be considered briefly. The frame element 6 has a pair of exterior framing members 90, 112 fixedly secured to a transverse framing member 115 to define the generally H-shaped configuration. A continuous axle 146 passes through a pivotable element 100 and a discontinuous axle 98, 99 passes through pivotable member 120. Continuous axle 140 passes through pivotable element 120 and continuous axle 146 passes through pivotable member 100.

Figure 4:
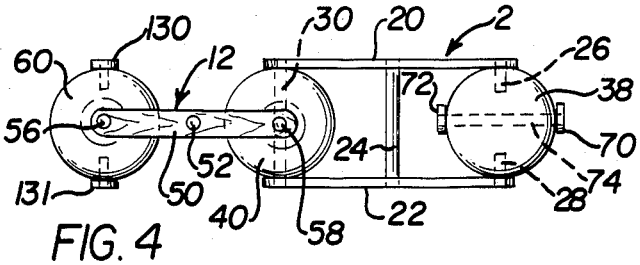
FIG. 4 is an elevational view showing two adjacent framing elements and their associated pivotable elements.

FIG. 4 shows a pair of adjacent frame elements 2, 12 which are 90 degrees out of phase or have been rotated to a position where one is perpendicular to the other considering, for example, the orientation of transverse framing member 24 with respect to transverse framing member 52. As a result of the positioning of the two frame elements, it will be appreciated that if frame 12 were to be rotated as a result of rotation of pivotable element 40 about axle 30, the movement would be in a direction into or out of the page. Freedom of rotation is also permitted about axle 58 which would result in rotation of frame element 12 within the plane of the page. By effecting a combination of rotations about these two axles 30, 58, a variety of positions may be achieved. As the system is a closed loop, however, rotation of one framing element with respect to the adjacent frame elements will result in responsive rotation of other portions of the closed loop.

Figure 5:
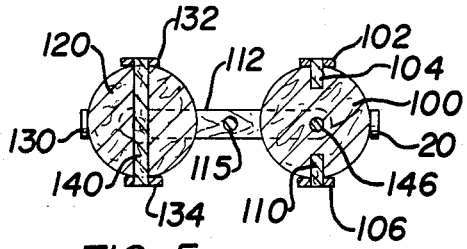
FIG. 5 is a cross-sectional illustration taken through 5—5 of FIG. 1.
Figure 6:
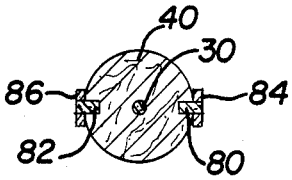
FIG. 6 is a cross-sectional illustration taken through 6—6 of FIG. 2.

As is seen in FIGS. 5 and 6, in the embodiment illustrated the apparatus has been made of wood. It will be appreciated that the apparatus may be made of other materials such as plastic or metal, for example, and that the pivotable elements need not be made of solid section, but could be hollow should such an approach be desired.

In order to preserve the modular concept and for simplicity of manufacture, it will generally be desired to use a solid axle as one axle of a frame element and a segmented axle as the other thereby permitting a given pivotable element to be rotated about a first axle which is solid and continuous and a second axle which is segmented.

Figure 7:
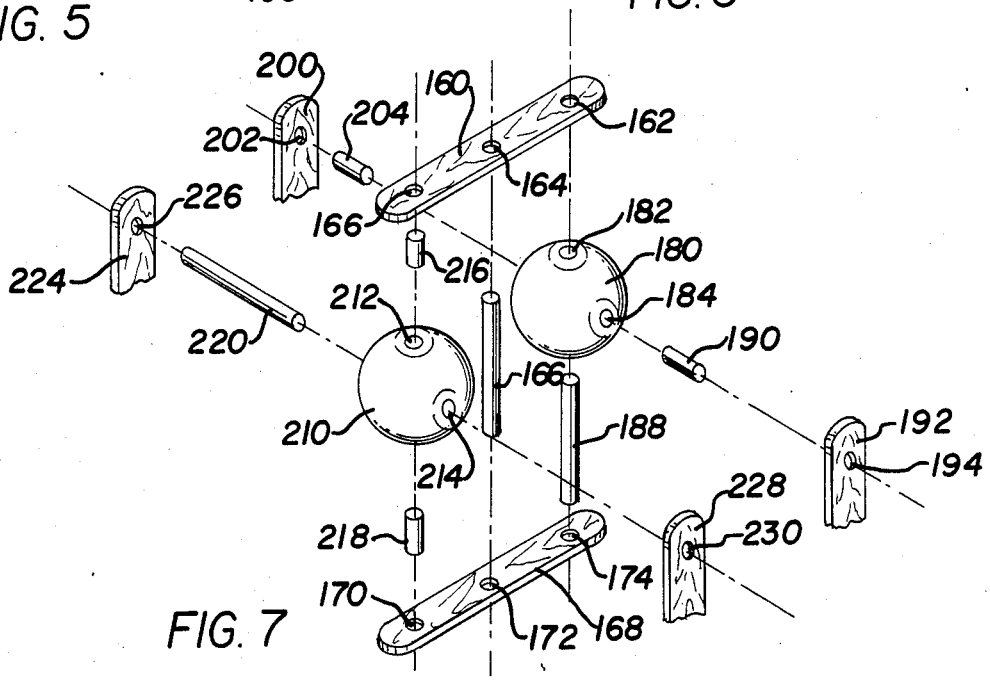
FIG. 7 is an isometric exploded view of a portion of the apparatus of FIG. 1.

Referring to FIG. 7, an exploded view of the apparatus is shown. It will be seen that a pair of exterior framing members 160, 168 each have a respective series of openings 162, 164, 166 and 170, 172, 174. Transverse framing member 166 is adapted to be fixedly received within openings 162 and 172. Continuous axle 188 is fixedly secured within openings 162, 174 and axle segment 216 is secured within opening 166 and axle segment 218 is secured within axle segment 170. At this point, a generally H-shaped element will provide an axle 188 which passes through opening 182 and pivotable element 180 and an axle 216, 218 which is received within opening 212 of pivotable element 210 thereby permitting free rotation of the elements 180, 210 about their respective axles. A pair of adjacent frame elements which are not illustrated in their entirety cooperate with the framing element defined by members 160, 168, 166 and pivotable elements 180, 210. A second frame element has exterior framing members 192, 200 which have openings 194, 202, respectively, and provide a segmented axle 190, 204 which is received within opening 184 of pivotable element 180. This provides a second axis about which pivotable element 180 may rotate. The second axis is oriented generally perpendicular with respect to the first axis of rotation. Similarly, a third frame element has exterior framing members 224, 228 which have respectively openings 226, 230 and receive a continuous axle 220. Axle 220 passes through opening or bore 214 is pivotable element 210 to create a second axis of rotation.

In a preferred embodiment of the invention the closed loop will be provided by an even number of frame elements. It is preferred that the loop have a minimum of six frame elements. It will be noted that the number of frame elements is equal to the number of pivotable elements.

While for convenience of illustration, the pivotable elements have been shown as being all of the same configuration and substantially spherical, it will be appreciated that other geometric shapes as well as other shapes may be employed and that all of the shapes need not be identical within a given closed loop.

While there is no particular limitation regarding the size of the object, the preferred embodiment illustrated in FIG. 1 may have a transverse dimension up about one and one-half to four inches and a height of about four to ten inches, for example.

Whereas particular embodiments of the invention have been described above for purposes of illustration, it will be evident to those skilled in the art that numerous variations of the details may be made without departing from the invention as defined in the appended claims.

I claim:

1. An apparatus comprising a plurality of frame elements, each said frame element having a pair of exterior frame members and a pair of axles oriented generally transversely with respect to said framing members, a plurality of pivotable elements each pivotally secured to two said frame elements, each said frame element having a pair of said pivotable elements rotatably secured thereto for rotation of each said element about a different one of said axles, said pivotable elements being at least partially received within said frame elements each said pivotable element being mounted for rotation about a first axis of a first said framing element and rotation about a second axis of a second framing element which is generally perpendicular with respect to the first axis, each said frame element having a transverse framing member fixedly secured to said exterior framing members, and said transverse framing member being disposed in spaced generally parallel relationship with respect to said axles.

2. The apparatus of claim 1 including the number of said pivotable elements being equal to the number of said framing elements.

3. The apparatus of claim 2 including each said pivotable element being mounted for rotation about a first axis of a first said framing element and rotation about a second axis of a second framing element.

4. The apparatus of claim 1 including
said axle means on each said framing element having a first axle which is continuous and a second axle which is discontinuous.
5. The apparatus of claim 4 including
each said pivotable element being rotatably mounted about a first axle of one said framing element and a second axle of another framing element.
6. The apparatus of claim 5 including
said pivotable elements having a geometric shape.
7. The apparatus of claim 6 including
said pivotable elements being substantially spherical.
8. The apparatus of claim 1 including
said framing elements and said pivotable elements combining to provide a closed loop assembly.
9. The apparatus of claim 8 including
said closed loop having an even number of said framing elements.
10. The apparatus of claim 9 including
a pair of adjacent said frame elements assuming positions wherein a plane passing through a frame member of a first frame element will be generally perpendicular to a plane passing through a frame member of an adjacent frame element.
11. The apparatus of claim 10 including
said apparatus having at least six said framing elements.
12. An apparatus comprising
a plurality of frame elements,
each said frame element having a pair of exterior frame members and a pair of axles oriented generally transversely with respect to said framing members,
a plurality of pivotable elements each pivotally secured to two said frame elements,
each said frame element having a pair of said pivotable elements rotatably secured thereto for rotation about said axles,
said pivotable elements being at least partially received within said frame elements,
each said framing element having a transverse framing member fixedly secured to said exterior framing members,
the number of said pivotable elements being equal to the number of framing elements,
each said pivotable element being mounted for rotation about a first axis of a first said framing element and rotation about a second axis of a second framing element, and
said first axis being generally perpendicular with respect to said second axis.
13. The apparatus of claim 12 including
said apparatus having an even number of framing elements.
14. The apparatus of claim 13 including
said transverse framing member being disposed between said pivotable elements secured to each said framing element.
15. The apparatus of claim 14 including
said pivotable element having lesser height than the spacing between a pair of said external framing members on said framing element.
16. An apparatus comprising
a plurality of frame elements,
each said frame element having a pair of exterior frame members and a pair of axles oriented generally transversely with respect to said framing members,
a plurality of pivotable elements each pivotally secured to two said frame elements,
each said frame element having a pair of said pivotable elements rotatably secured thereto for rotation about said axles,
said pivotable elements being at least partially received within said frame elements,
each said framing element having a transverse framing member fixedly secured to said exterior framing members,
said framing elements and said pivotable elements combining to provide a closed loop assembly,
said closed loop having an even number of said framing elements,
a pair of adjacent said frame elements assuming positions wherein a plane passing through a frame member of a first frame element will be generally perpendicular to a plane passing through a frame member of an adjacent frame element, and
said framing elements and said pivotable elements providing a plurality of universal joint connections within said loop.

* * * * *